US005113844A

United States Patent [19]

Cook

[11] Patent Number: 5,113,844

[45] Date of Patent: May 19, 1992

[54] HEAT EXCHANGER

[75] Inventor: Robert W. Cook, Mt. Waverley, Australia

[73] Assignee: Vulcan Australia Limited, Bayswater, Australia

[21] Appl. No.: 689,290

[22] PCT Filed: Dec. 12, 1989

[86] PCT No.: PCT/AU89/00529

§ 371 Date: Jun. 13, 1991

§ 102(e) Date: Jun. 13, 1991

[87] PCT Pub. No.: WO90/07091

PCT Pub. Date: Jun. 28, 1990

[51] Int. Cl.[5] ..... F24H 3/02

[52] U.S. Cl. ..... 126/110 R; 126/116 R

[58] Field of Search ..... 126/110 R, 116 R, 110 B, 126/116 B

[56] References Cited

U.S. PATENT DOCUMENTS 2,089,969 8/1937 Kuenhold ..... 126/116 R 2,715,399 8/1955 Witt et al. .

3,102,530 9/1963 Diehl ..... 126/110 R 4,275,705 6/1981 Schaus .

*Primary Examiner*—Carroll B. Dority

*Attorney, Agent, or Firm*—Flehr, Hohbach, Test, Albritton & Herbert

[57] ABSTRACT

A heat exchange assembly having a primary heat exchange element (20) intercommunicating with secondary heat exchange element (24) both housed in an enclosure (12). Hot combustion products from burner (28) are forced by fan (19) through the primary and secondary heat exchange elements in turn to an exhaust (31) whilst air to be heated is induced by fan (14) through enclosure (12). The flow direction of hot combustion products and their temperature drop along their flow path when considered with the flow direction of air being heated and delivered from outlet (16) of enclosure (12), ensures heat exchange characterized predominantly as counter-current and hence optimally efficient in consideration of the compact dimensions of the enclosure (12).

11 Claims, 4 Drawing Sheets

HEAT EXCHANGER

BACKGROUND

This invention relates to a heat exchange assembly and concerns the configuration and nature of heat exchange elements within such an assembly to optimize efficiency.

Heat exchangers are used in a number of different applications. These include use in heaters having application in domestic and industrial situations. Heat exchangers have commonly been used in central heating apparatus in which air to be heated and diverted to one or more room outlets is blown through the heat exchange assembly and the present invention has been developed primarily for this application. However, the present invention is not limited to such use.

A heat exchanger is a device that transfers heat from one fluid to another without allowing the fluids to come into contact with each other. The fluid being heated in the case of a central heater is of course ambient air. The efficiency of a heat exchanger is generally enhanced if the fluid to which heat is to be transferred passes through the heat exchanger in the opposite direction to the direction of the fluid transferring heat. Such an arrangement is known as counter-current heat exchange. Counter-current heat exchange is generally more efficient than co-current heat exchange due to the maintenance of a greater temperature differential between the two respective fluids along the length of the heat exchanger.

This concept has been adopted in the past in the design of central heating apparatus but has required the use of large and cumbersome assemblies for the enclosure of the heat exchange elements. The size of such assemblies has made underfloor and roof installation difficult and in some cases not possible.

An object of the present invention is to provide an improved heat exchange assembly which is thermodynamically efficient. It is a further object of the invention to provide a heat exchange assembly which is compact.

SUMMARY

The invention consists of a heat exchange assembly comprising at least one primary and at least one secondary heat exchange element housed within an outer enclosure, a fan and heating means; said enclosure comprising inlet and outlet openings for respectively receiving air to be heated and delivering heated air drawn into and forced through the said enclosure by the fan; wherein each primary heat exchange element is a metallic substantially planar panel and includes an "S" shaped passage having an opening located proximate the rearward end of the enclosure and a exit orifice proximate the forward end of the enclosure and wherein each secondary heat exchange element is a metallic substantially planar panel and includes an inlet proximate the forward end of the enclosure connected by a passage or passages to an outlet proximate the rearward end of the enclosure, the said inlet of each secondary heat exchange element communicating with an exit orifice of at least one primary heat exchange element and said outlet of each secondary heat exchange element communicating with an exhaust outlet of the enclosure whereby said heating means is adapted to heat and cause a heat exchange fluid to move sequentially through the primary and secondary heat exchange elements and whereby air to be heated is forced from the rearward end of the enclosure to the forward end of the enclosure in a stream generally parallel to the plane of the said heat exchange elements.

The primary heat exchange element or elements may be a metallic plate with an "S" shaped conduit attached to an outer surface. Preferably, the primary heat exchangers are formed from a pair of metallic sheets having corresponding embossments formed therein to provide an internal passage through which the heating fluid may flow. The shape of the passage is substantially "S" shaped so that three portions of the passage are substantially parallel to the flow of the ambient air past the heat exchange element and substantially parallel to each other. As the heated fluid travels through the passage to the exit orifice, its temperature drops. Thus, if the heated fluid is a gas it is desirable to reduce the cross-sectional area of the passage as it approaches the exit orifice to maintain constant gas velocity through the passage from the inlet. The reduction in cross sectional area takes into account the reduction in the specific volume of the gas on temperature reduction. Where the primary heat exchanger is formed from a pair of embossed metallic sheets, it is desirable to also form a frusto-conical section at the exit orifice so that interconnection with a further primary heat exchanger or a secondary heat exchanger can be effected by a single seal without requiring separate interconnecting members.

The heating means may be of any type known in the art. However, most preferably a gas burner is utilized. Higher efficiency is obtained if the gas burner is associated with a separate fan to cause forced or induced combustion. In this aspect of the invention, the gas burner and associated fan are preferably enclosed in a separate cavity external of the outer enclosure housing the heat exchange elements and an inlet is provided for induction of air into this cavity by the fan. The gas burner or burners are fitted to direct a flame into the opening of each of the primary heat exchange elements. No outlet is provided in the cavity for the induced air flow other than the openings of the primary heat exchange elements and this causes the air to enter the primary heat exchanger opening under pressure.

The secondary heat exchanger or exchangers may be of various different configurations known in the art having one or more passages between the inlet and outlet at opposite ends of the heat exchanger element. It has been found that a heat exchanger assembly of the present invention operates with higher efficiencies if the secondary heat exchanger includes a plurality of paths linking the inlet and outlet of the exchanger element. Preferably the secondary heat exchangers are formed from a pair of metallic sheets having elongated inwardly facing embossments formed thereon so that when the pair of plates are joined together the elongated embossments of the respective plates criss-cross and contact each other at the intersection of the respective embossments to provide a plurality of internal passages in the secondary heat exchanger.

Such configuration provides a series of notionally "parallel" paths interconnecting the inlet and outlet of the secondary heat exchanger and each such path is substantially equidistant thus avoiding localised tracking and hence hot spots.

Furthermore, in such an embodiment, it is possible to utilize inlet and outlet plenums which enhance uniform distribution of the heated fluid through the secondary heat exchanger. The secondary heat exchanger is also preferably pressed to form a raised connecting section at the inlet opening to co-operate with a similar connecting section on the exit orifice of a primary heat exchanger or the inlet of a further secondary heat exchange element.

The primary and secondary heat exchangers may be arranged in the outer enclosure in any order. Preferably, the heat exchangers closest to the external wall of the outer enclosure are secondary heat exchangers. Thus, it is preferably to have at least two secondary heat exchangers-one adjacent both of the longitudinal walls of the outer enclosure. The reason for utilizing secondary heat exchangers adjacent the walls of the assembly is to minimize radiant heat loss through the walls. When in use, the secondary heat exchangers are not as hot as the primary heat exchangers and thus, utilization of the secondary heat exchangers at these positions enables use of less insulation than in conventional heat exchangers. There is no restriction on the number of each type of exchanger which may be combined to provide a particular nominal energy output. Thus. for example, it is envisaged that a 90 megajoule (MJ) requirement could be met by an assembly containing three primary and three secondary heat exchangers of the type described. Similarly, a 120 MJ requirement could be met by four primary and four secondary heat exchangers and a 150 MJ requirement could be met by either five primary and five secondary or four primary and six secondary heat exchangers. Preferably in each case all the primary exchangers would be located centrally within the assembly with one or more secondary heat exchangers on either side of the primary heat exchangers.

Each primary heat exchanger is preferably interconnected with at least one secondary heat exchanger so that the heated fluid may pass sequentially through the passage in the primary heat exchange element and then through the passages of the secondary heat exchanger. Interconnecting conduits may be used to link separate heat exchange elements but as previously stated, each panel is preferably stamped with a raised section at the exit orifice (in the case of the primary heat exchange element) and at the inlet (in the case of the secondary heat exchange element) to permit sealing at one point.

In operation, it has been found that the configuration and shape of the respective heat exchangers in the assembly of the invention confer efficiencies normally associated with counter-current heat exchangers notwithstanding the fact that the assembly is not a true counter-current heat exchanger. As the secondary heat exchangers are "folded back" in the reverse direction to the primary heat exchangers counter-current heat exchange is obtained along these elements. The primary heat exchange elements have their inlets at the rearward end of the assembly and their exit orifices at the forward end of the assembly. Accordingly, air passing over the heat exchange element is essentially co-current. However, by use of a substantially "S" shaped passage for delivery of the heated fluid, regions of the primary heat exchanger are also substantially counter-current to the flow of the ambient air being heated.

The primary heat exchanger can essentially be considered as three separate portions. The first portion from the passage opening to the first bend is substantially co-current with the air to be heated, the second portion is a section running substantially parallel to the first portion and runs between the first bend in the passage to the second bend of the passage and is substantially counter-current with the air to be heated and the third portion again runs substantially parallel to the first and second portions and runs from the second bend in the passage to the exit orifice. The third portion is co-current with the air to be heated. Thus, a primary heat exchanger used in the present invention has a significant portion which runs counter-current notwithstanding the fact that overall the primary heat exchanger carries heated fluid co-current to the passage of the air being heated.

In the embodiment of the invention where fan forced gas combustion is used as the heating means additional benefits are obtained with the assembly of the invention. In particular, where fan forced gas burners are utilized it has been discovered that the hottest part of the primary heat exchanger is at the position close to the end of the first portion (i.e. close to the first bend). This occurs due to the forced flow of air into the passage of the primary heat exchanger. The flame of the gas burner is directed into the opening at the side of the passage immediately next to the opening is cooled by incoming forced air. Combustion occurs well into the first portion of the passage and thus, contrary to expectation, the first portion of the passage is coolest at the opening and hottest at a position close to the first bend. Therefore in this embodiment of the invention, the heat distribution along the first portion confers benefits usually associated with counter-current flow. Overall, in this embodiment the difference in temperature between the incoming air to be heated and the temperature of the heat exchangers is enhanced providing providing significant efficiencies in heat transfer. The configuration, through use of the serpentine primary heat exchanger and fold back secondary heat exchanger also provide significant advantages through being more compact than equivalent energy output conventional heat exchange assemblies.

DESCRIPTION OF THE DRAWINGS

The invention is described with reference to a particularly preferred embodiment by way of example as shown in the accompanying illustrations in which.

DETAILED DESCRIPTION

Figure 1:
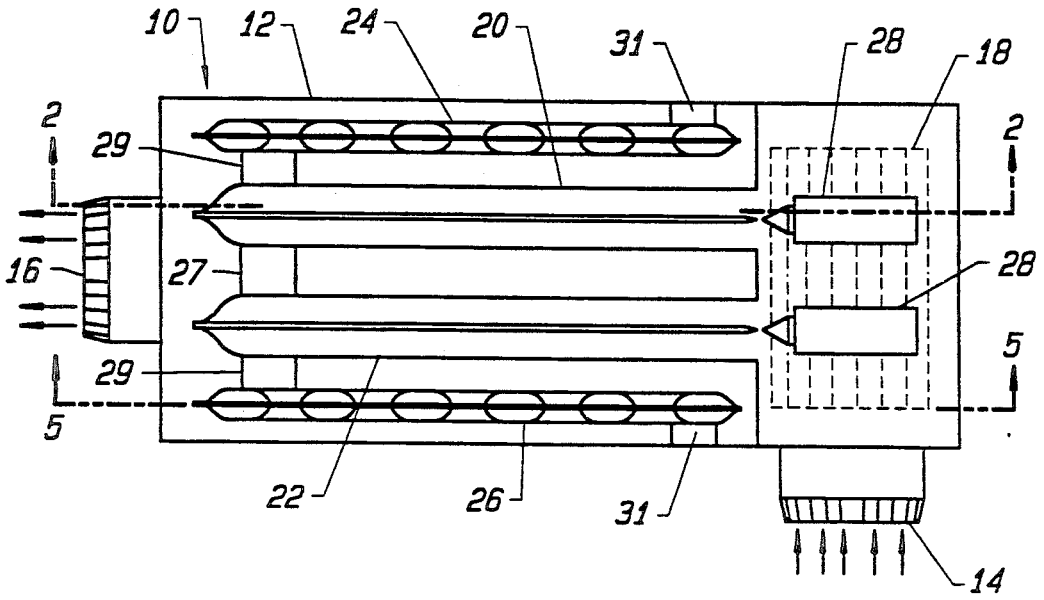
FIG. 1 is a schematic plan view to a reduced scale of a heat exchanger assembly according to the invention.

Referring to FIG. 1, one embodiment of the heat exchanger assembly 10 according to the invention is shown in which a sheet metal outer enclosure 12 has major openings 14 for inlet (cool) air and 16 for outlet (heated) air, the air being induced through the assembly by fan 18. Also within the enclosure 12 are a pair of primary heat exchangers 20 and 22 and a pair of secondary heat exchangers 24 and 26 all arranged in a parallel, closely spaced array with the secondary heat exchangers 24 and 26 screening the primary heat exchangers 20 and 22 from direct exposure to the side walls of the enclosure. All the heat exchangers are constructed from sheet metal. Internal interconnections, to be described in more detail with reference to subsequent figures, between the primary and secondary heat exchangers are respectively numbered 27 and 29. Exhaust connections 31 connect the outlets of the secondary heat exchangers 24 and 26 with the atmosphere or, to external flue(s), not shown. Alternatively, the outlets of the secondary heat exchangers 24 and 26 may be connected to a common manifold (not shown) to vent the exhaust gas out either side of the assembly.

Figure 2:
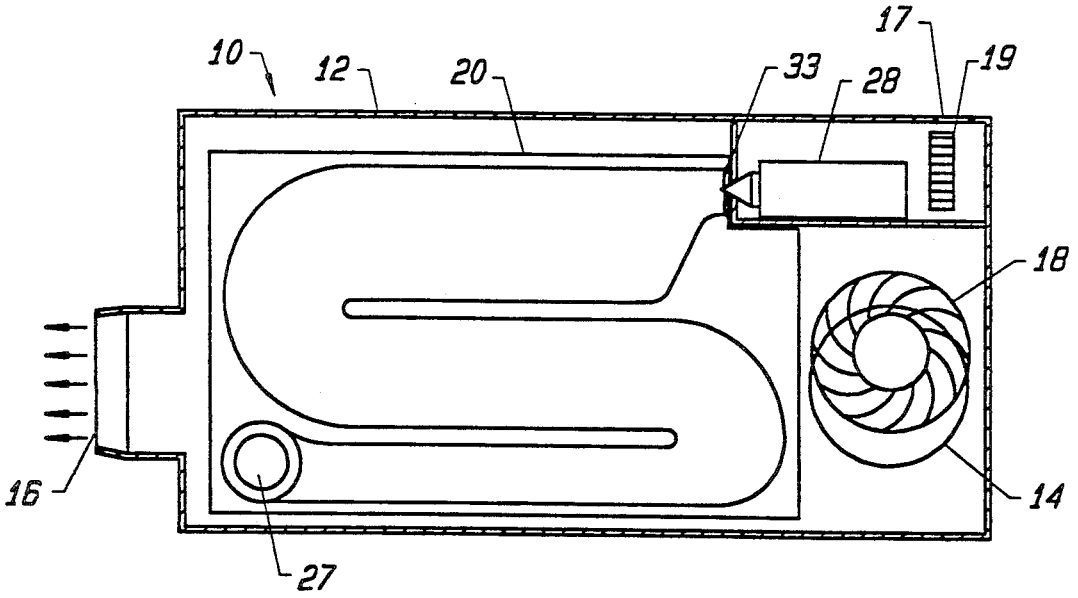
FIG. 2 is a schematic cross-sectional elevation of the heat exchanger assembly as shown in FIG. 1 and sectioned along the line II—II of the primary heat exchanger.

In FIG. 2, a cross-section of primary heat exchanger 20 is schematically shown. A separate cavity 15 is provided which is sealed from the inside of outer enclosure 12. Cavity 15 has an inlet 17 for introduction of ambient air into the cavity. A combustion air fan 19 is located adjacent the inlet 17 to draw air into the cavity. Opening 33 of primary heat exchanger 20 extends into the cavity 15 and an associated burner 28 directs flame and hot combustion products into the opening 33 of the primary heat exchanger. The air drawn into the cavity causes forced combustion within the primary heat exchanger.

Figure 3:
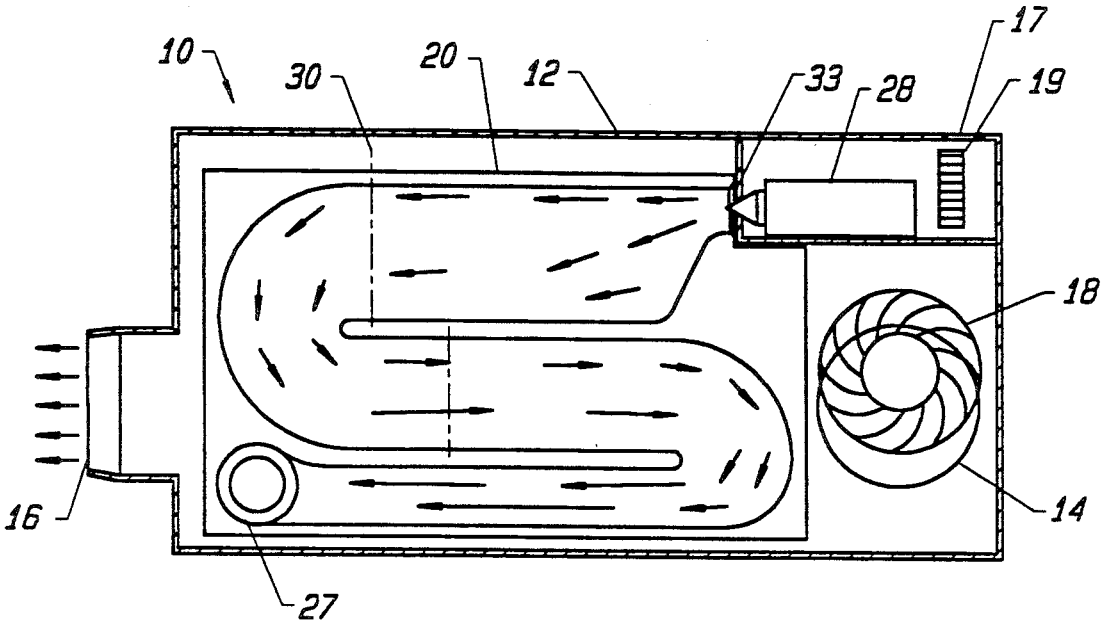
FIG. 3 is a schematic cross-section elevation of the heat exchanger assembly as shown in FIG. 1 showing the direction of gas and air flow in a primary heat exchanger.

In FIG. 3, a schematic reproduction of FIG. 2 is repeated to show the flow direction of combustion products in the primary heat exchanger. Air to be heated by the heat exchanger assembly 10 is induced into the inlet by fan 18 and moves forwardly through the assembly, that is from right to left in the illustration, in paths generally parallel to the straight portions of the combustion product passage through the primary heat exchanger 20.

The heat distribution along the passage of the primary heat exchanger provides the benefits of maximized heat differential between a significant proportion of the area of the heat exchanger and the air to be heated. The hottest region of the heat exchanger 20 is between dotted lines 30 and 32. This is in part due to the cooling effect of incoming induced air from cavity 15 at opening 33 but also due to the fact that the majority of the incoming air is not converted to combustion product until it has travelled a significant distance into the first portion of the passage of primary heat exchanger 20. Thus, in the first two parallel portions of primary heat exchanger 20, the hottest part of the passage is at the forward end (i.e. furthest from the ambient air inlet) and the coolest part of the passage is at the rearward end (i.e. closest to the ambient air inlet). The cool inlet air thus first contacts the cooler part of the first and second parallel portions of the passage. In the first portion, the heat distribution is such that the air passing over the element whilst co-current with the flow of combustion product is heated with efficiency comparable to a counter-current situation. The second portion of the primary heat exchanger is counter-current. The third portion is co-current with the flow of ambient air but the sacrifice in efficiency in this section is minimized due to the reduced volume of the passage in the third portion of the passage of the primary exchanger.

The combustion products leave the primary heat exchanger at outlets 27 and 29 (see FIG. 1) which may interconnect with further primary heat exchangers combined in a parallel array (as with 27 and FIG. 1) or may interconnect as at 29 with secondary heat exchangers (24, 26) arranged in parallel array outside one or more primary heat exchangers.

Figure 4:
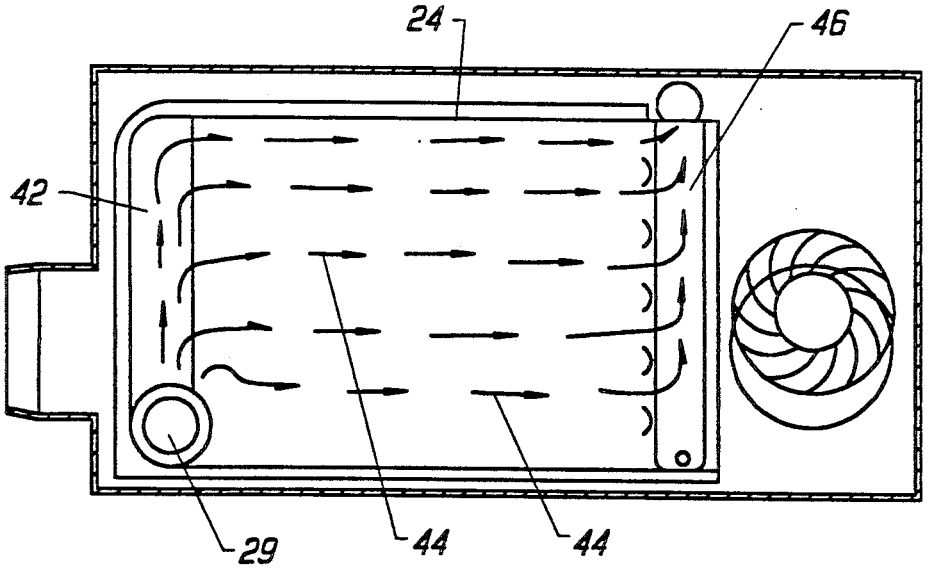
FIG. 4 is a schematic cross-sectional elevation of the heat exchanger assembly as shown in FIG. 1 showing the direction of gas and air flow in a secondary heat exchanger.

With reference to FIG. 4, the heat exchange fluid flow path taking place in the secondary heat exchanger 24 is illustrated. The secondary heat exchanger 24 will be described in further detail in relation to FIG. 5. As illustrated in FIG. 4, the hot flue gas leaving the primary heat exchanger enters the secondary heat exchanger at 29 and fills inlet plenum 42. A series of notionally "parallel" paths 44 (see FIG. 6) interconnect inlet plenum 42 and an outlet plenum 46. Each path 44 provides substantially equidistant alternative paths for gases travelling through the secondary heat exchanger, thus avoiding localised tracking and hence hot spots. Thus, the full area of the secondary heat exchanger is utilized efficiently in keeping with the general objective of maximising heat transfer in the heat exchanger assembly. The secondary heat exchanger is of course entirely counter-current to the flow of incoming ambient air, maximizing the heat exchange from the combustion product after passage through the primary heat exchanger.

Figure 5:
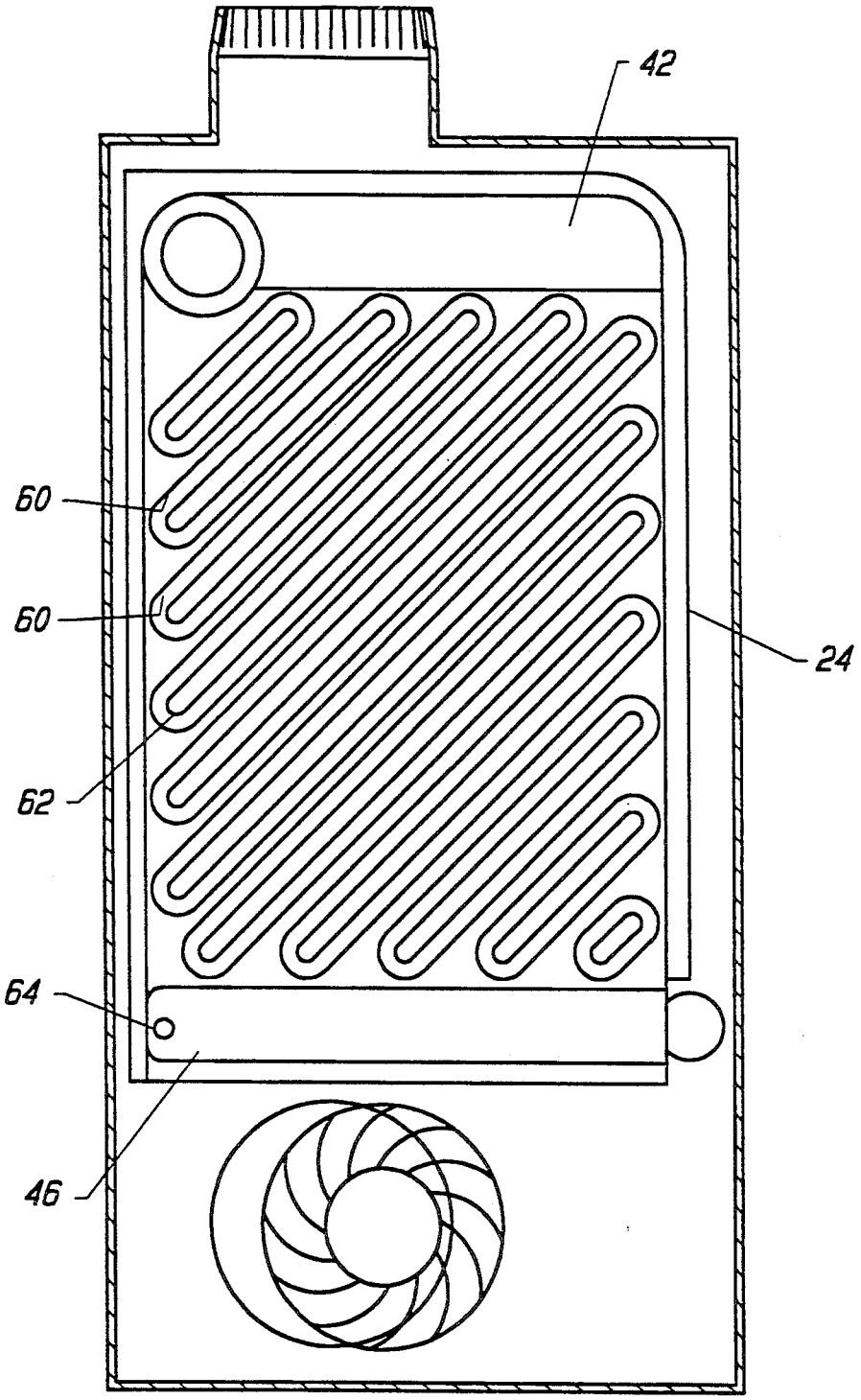
FIG. 5 is a cross-sectional elevation view of a cross-section as indicated by the line V—V of FIG. 1.

With reference to FIG. 5, the secondary heat exchanger 24 is shown in half cross-section positioned within the enclosure 12 as it is in the heat exchanger assembly. The half section of the secondary heat exchanger 24 comprises an inlet plenum 42, an outlet plenum 46 and a first set of elongated embossments 60 formed at an angle of 45° to the edges of the rectangular secondary heat exchanger. The secondary heat exchanger is preferably formed from stainless steel sheet. The crests 62 of the embossments 60 form a planar array to intersect and contact with the opposite half (not shown in FIG. 5) of the secondary heat exchanger, to be described below with reference to FIG. 6. The outlet plenum 46 is provided with a condensate outlet 64 since the heat exchanger assembly as a whole is designed to operate in condensing mode in order to extract the highest possible amount of heat from the combustion of the fuel.

Figure 6:
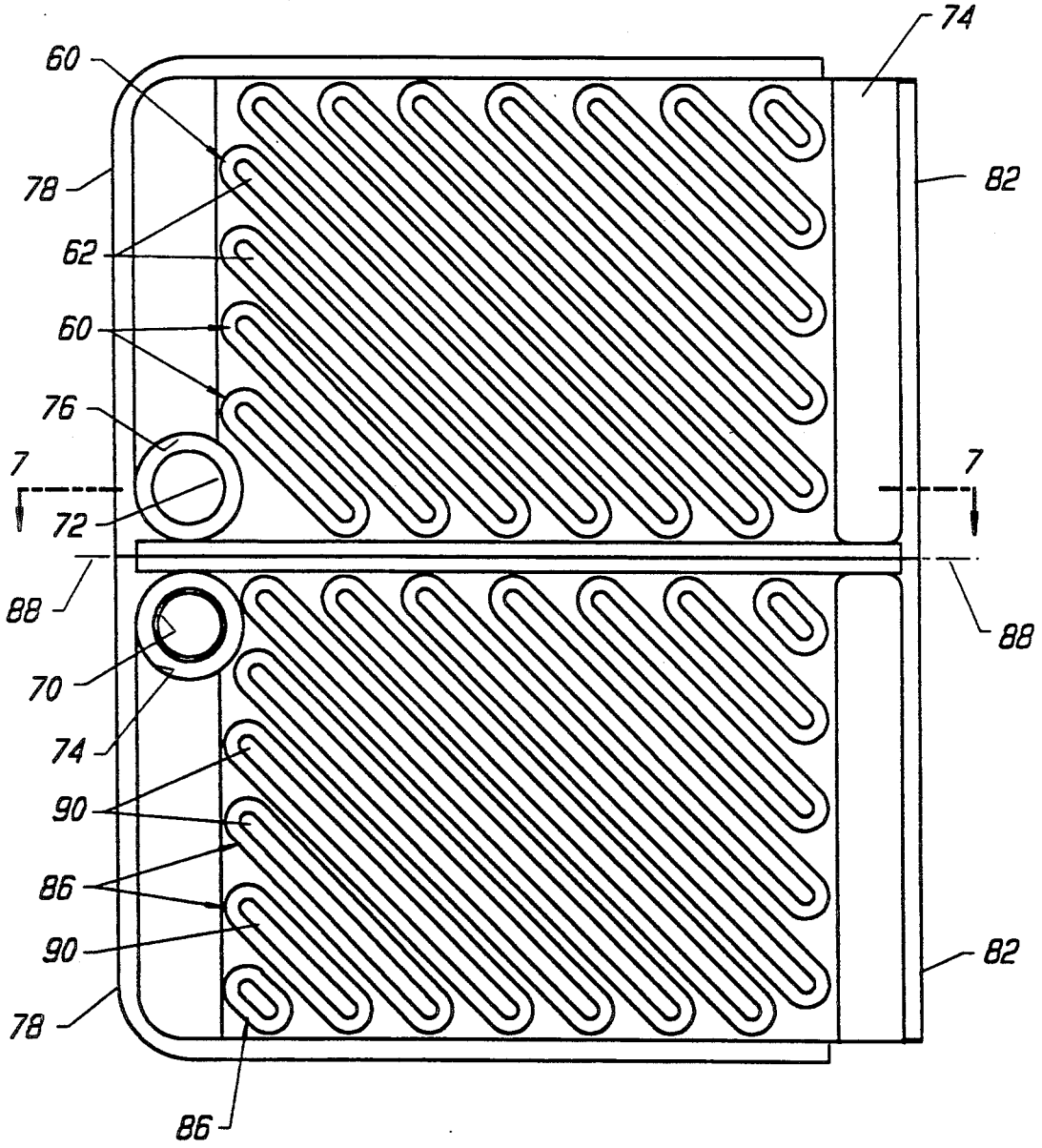
FIG. 6 is a view of a secondary heat exchanger after pressing operations in its production but prior to folding and edge sealing operations.

With reference to FIG. 6 and accompanying sectional part views, the secondary heat exchanger 24 is formed from a single rectangular sheet of stainless steel. The sheet is subjected to blanking, drawing, piercing and extruding operations to form the features as further described below.

The first set of eleven elongated embossments 60 has been described in relation to FIG. 5.

Inlet openings 70 and 72 are pierced in locally embossed areas 74 and 76 which are blended with a second set of raised elongated embossments 78 which will form after folding (described below) the inlet plenum 42 (see FIG. 5). A third set of elongate embossments 82 are formed along the opposite edge of the sheet to the first pair to become (after folding) the outlet plenum 46 (see FIG. 5).

A fourth set of elongated embossments 86 is formed at an angle of 45° to the edge of the plate and parallel to the first set. The fourth set of embossment number ten as distinct from the eleven of the generally similar first set.

The pressing as thus far described is then folded about the central axis 88—88 so that opposing edges contact at intersecting points. The edges are then sealed, by any suitable means, except where an open end 47 (see FIG. 5) of the outlet plenum is formed as a result of the mating of the second set of embossments 82. The panel is preferably also fixed at 4 to 6 locations throughout the panel to minimize movement of the two parts under internal pressure.

The intersection of the first and fourth set of embossments, 60 with 86, results in their being crossed with respect to each other at an angle of 90°. The small area-to-small area contact of the respective crests 62 and 90 of the embossments 60 and 86 (respectively) create in the interior of the heat exchanger a labyrinth of interconnecting passages joining the inlet and outlet plena (42 and 46 of FIG. 5). This provides the particularly advantageous multiple parallel gas flow paths as already described in relation to FIG. 4.

Figure 7:
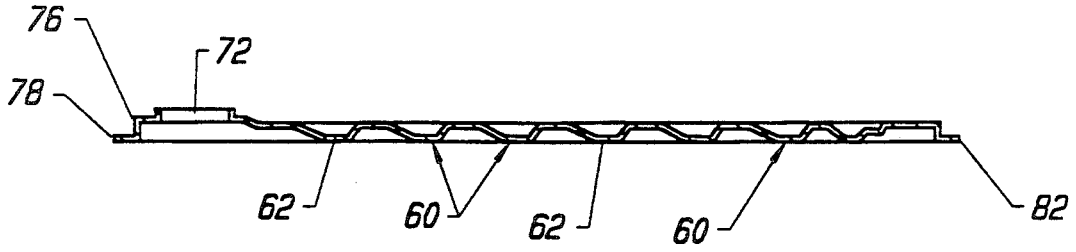
FIG. 7 is a cross-sectional view as indicated by line VI—VI of FIG. 6.

FIG. 7 shows a cross-sectional view passing through inlet opening 72 and through elongated embossments 60. It shows how the crests 62 and the embossments 78 and 82 are co-planar, and consequently will contact their counterparts upon folding of the secondary heat exchange element about axis 88—88, creating a labyrinth of interconnecting passages joining the inlet and outlet plena. It also shows the way in which inlet opening 72 is raised beyond locally embossed area 76 to enable a single seal to be used to connect the inlet opening with the exit orifice of a primary heat exchange element or the inlet of a further secondary heat exchange element.

In operation, ambient air is drawn into the assembly by fan 18 through inlet 14 and passes through the heat exchanger assembly between the parallel spaced array of secondary and primary heat exchangers. The heat distribution throughout the heat exchangers allows efficient heat transfer as hereinbefore described.

Heat exchange assemblies according to the invention can be constructed in outer enclosures considerably smaller than existing units and the width of the unit can be chosen so that the assembly can be fitted between roof rafters (making roof installation considerably simpler) or between vertical studs in a supporting wall. Thus, the heat exchanger of the present invention is useful in a number of different applications but can in particular be utilized in central heating or wall furnace applications.

Finally, it is to be understood that various alterations, modifications and/or additions may be introduced into constructions and parts previously described without departing from the spirit or ambit of the invention as claimed in the following claims.

I claim:

1. A heat exchange assembly comprising at least one primary and at least one secondary heat exchange element housed within an outer enclosure, a fan and heating means; said enclosure comprising inlet and outlet openings for respectively receiving air to be heated and delivering heated air drawn into and forced through the said enclosure by the fan; wherein each primary heat exchange element is a metallic substantially planar panel and includes an "S" shaped passage having an opening located proximate the rearward end of the enclosure and an exit orifice proximate the forward end of the enclosure and wherein each secondary heat exchange element is a metallic substantially planar panel and includes an inlet proximate the forward end of the enclosure said secondary heat exchange element connected by a passage or passages to an outlet proximate the rearward end of the enclosure, the said inlet of each secondary heat exchange element communicating with an exit orifice of at least one primary heat exchange element and said outlet of each secondary heat exchange element communicating with an exhaust outlet of the enclosure whereby said heating means is adapted to heat and cause a heat exchange fluid to move sequentially through the primary and secondary heat exchange elements and whereby air to be heated is forced from the rearward end of the enclosure to the forward end of the enclosure in a stream generally parallel to the plane of the said heat exchange elements.

2. A heat exchange assembly according to claim 1 wherein the heating means comprises a gas burner and an associated fan adapted to force the combustion products of the burner through the passages of the primary and secondary heat exchange elements.

3. A heat exchange assembly according to claim 2 wherein the gas burner is directed into the entrance of the "S" shaped passage of the primary heat exchanger so that combustion occurs at least part way into the "S" shaped passage.

4. A heat exchange assembly according to claim 1 wherein the heating means is housed within a heater housing.

5. A heat exchange assembly according to claim 4 wherein the opening of said "S" shaped passage of each primary heat exchanger is adjacent to said heater housing.

6. A heat exchange assembly according to claim 1 wherein the passage for heat exchange fluid flow in one or more of the secondary heat exchange elements comprises a multi-pathed passage between the inlet and outlet of the said elements.

7. A heat exchange assembly according to claim 6 wherein the secondary heat exchanger is formed from a pair of metallic plates having elongated inwardly facing embossments formed thereon which are joined together such that the elongated embossments of the respective plates intersect to provide a plurality of internal passages.

8. A heat exchange assembly according to claim 1 wherein the "S" shaped passage of the primary heat exchanger is formed within the primary heat exchange panel.

9. A heat exchange assembly according to claim 1 wherein the "S" shaped passage of the primary heat exchanger is separate from said enclosure.

10. A heat exchange assembly according to claim 1 wherein there are two or more primary heat exchange elements and each of associated "S" shaped passages is connected to either an exit orifice or an adjacent primary heat exchange element or the inlet of a secondary heat exchange element.

11. A heat exchange assembly according to claim 1 wherein there are at least two secondary heat exchange elements which are respectively situated adjacent and substantially parallel to the two opposite sides of the outer enclosure.

* * * * *